US006786049B2

(12) United States Patent
Parsons et al.

(10) Patent No.: US 6,786,049 B2
(45) Date of Patent: Sep. 7, 2004

(54) FUEL SUPPLY CONTROL FOR A GAS TURBINE INCLUDING MULTIPLE SOLENOID VALVES

(75) Inventors: Douglas A. Parsons, Canton, CT (US); Constantine Semyanko, Suffield, CT (US)

(73) Assignee: Hamilton Sundstrand, Windsor Locks, CT (US)

( * ) Notice: Subject to any disclaimer, the term of this patent is extended or adjusted under 35 U.S.C. 154(b) by 15 days.

(21) Appl. No.: 10/152,753

(22) Filed: May 22, 2002

(65) Prior Publication Data

US 2003/0217545 A1 Nov. 27, 2003

(51) Int. Cl.[7] ..... F02G 7/22; F02G 7/26
(52) U.S. Cl. ..... 60/776; 60/39.281
(58) Field of Search ..... 60/773, 776, 739, 60/39.281

(56) References Cited

U.S. PATENT DOCUMENTS

| | | | | | |
|---|---|---|---|---|---|
| 3,688,495 | A | * | 9/1972 | Fehler et al. | 60/39.281 |
| 4,027,474 | A | | 6/1977 | Demase | |
| 4,454,713 | A | * | 6/1984 | Meyer et al. | 60/39.281 |
| 4,640,093 | A | * | 2/1987 | Eastman | 60/39.281 |
| 4,920,740 | A | * | 5/1990 | Shekleton | 60/790 |
| 4,926,629 | A | * | 5/1990 | Eick et al. | 60/39.281 |
| 5,029,441 | A | | 7/1991 | Parsons | |
| 5,036,657 | A | | 8/1991 | Seto et al. | |
| 5,046,923 | A | | 9/1991 | Parsons et al. | |
| 5,051,918 | A | | 9/1991 | Parsons | |
| 5,052,917 | A | | 10/1991 | Saito et al. | |
| 5,189,620 | A | | 2/1993 | Parsons et al. | |
| 5,205,116 | A | * | 4/1993 | Ng | 60/39.281 |
| 5,303,142 | A | | 4/1994 | Parsons et al. | |
| 5,321,949 | A | | 6/1994 | Napoli et al. | |
| 5,349,811 | A | * | 9/1994 | Stickler et al. | 60/776 |
| 5,423,175 | A | | 6/1995 | Beebe et al. | |
| 5,884,483 | A | * | 3/1999 | Munro | 60/739 |
| 5,927,067 | A | | 7/1999 | Hanloser et al. | |
| 6,095,793 | A | | 8/2000 | Grebb | |
| 6,182,438 | B1 | | 2/2001 | Weber | |
| 6,209,309 | B1 | | 4/2001 | McArthur | |
| 6,274,945 | B1 | | 8/2001 | Gilbreth et al. | |
| 6,278,262 | B1 | | 8/2001 | Ullyott | |
| 6,282,882 | B1 | | 9/2001 | Dudd, Jr. et al. | |
| 6,295,801 | B1 | | 10/2001 | Burrus et al. | |
| 6,314,717 | B1 | | 11/2001 | Teets et al. | |

FOREIGN PATENT DOCUMENTS

| | | |
|---|---|---|
| EP | 1 077 349 A1 | 2/2001 |
| EP | 1 182 401 A1 | 2/2002 |

OTHER PUBLICATIONS

European Search Report Aug. 25, 2003.

* cited by examiner

*Primary Examiner*—Justine R. Yu
*Assistant Examiner*—William H. Rodriguez
(74) *Attorney, Agent, or Firm*—Carlson, Gaskey & Olds

(57) ABSTRACT

A fuel supply control system for a gas turbine includes a plurality of solenoid valves. The solenoid valves are energized in a timing sequence with a phase relationship designed to achieve a desired fuel flow. In one example, one solenoid valve is associated with a primary portion of a fuel manifold while at least two other solenoids are associated with a secondary portion of the manifold. A controller that energizes the solenoids to achieve the desired fuel flow can receive feedback information regarding turbine performance to make adjustments to the solenoid operation to bring the turbine performance closer to a desired level.

19 Claims, 4 Drawing Sheets

FUEL SUPPLY CONTROL FOR A GAS TURBINE INCLUDING MULTIPLE SOLENOID VALVES

BACKGROUND OF THE INVENTION

1. Field of the Invention

This invention generally relates to fuel supply control for gas turbines. More particularly, this invention relates to a fuel supply for gas turbines having a plurality of solenoid valves that are controlled to achieve a desired fuel flow rate.

2. Description of the Prior Art

Gas turbines are well known and used in various applications. Common elements within all gas turbines include a compressed air source, a fuel supply, a fuel combustor and a power turbine. The fuel and compressed air are mixed within the combustor where they are ignited and the resulting energy powers the turbine. There are a variety of configurations and variations upon the basic turbine structure.

In many situations, the fuel supply includes a primary portion and a secondary portion. A flow divider valve is often incorporated into the system to control the flow of fuel to the primary or secondary portions of the fuel supply. For example, the flow divider valve is controlled to direct fuel flow to the primary fuel supply portion during engine start-up while fuel is directed through the secondary portion during normal engine operation. While flow divider valves have proven effective for this purpose, they tend to introduce complexity and expense into the system. Accordingly, it is desirable to provide an alternative to conventional flow divider valve arrangements.

While other types of valves are commercially available, there are control considerations that must be accommodated to effectively and properly operate most gas turbines. The requirements for controlling the timing of fuel flow into the combustor cannot be accommodated by most simple valves. For example, an electrically driven solenoid valve, which presents an economically attractive arrangement, typically does not have adequate response time to provide desired fuel flow control. Given the operating frequencies and the need to tightly control the amount of fuel flow for most turbines, a typical solenoid valve will not provide adequate performance. The possibility exists for the solenoid to remain closed for too long, which presents the possibility for engine flameout. On the other hand, attempting to pulse larger amounts of fuel flow at a relatively low frequency, which may be within the solenoid operating range, tends to cause large releases of energy from the turbine which is typically accompanied by undesirable additional noise.

There is a need for an improved valving arrangement to control fuel flow in a gas turbine that is capable of operating at frequency levels where the amount of fuel is tightly controlled so that the desired turbine operation is achieved without additional noise.

This invention addresses that need while eliminating the requirement for a flow divider valve.

SUMMARY OF THE INVENTION

In general terms, this invention is a fuel flow control system for use in a gas turbine.

A system designed according to this invention includes a fuel source. At least one manifold is coupled with the fuel source. A plurality of nozzles near an end of the manifold allow fuel to exit the manifold. A plurality of solenoid valves are associated with the manifold between the nozzles and the fuel source. A controller selectively opens and closes the solenoid valves, respectively, to provide a desired amount of fuel flow through the nozzles.

The controller preferably uses pulse width modulation in one example to control the solenoid valves and a time within a cycle during which fuel flows through the nozzles is greater than an open time for any one of the solenoid valves. The open times for the solenoid valves are set and timed relative to each other (i.e., phase controlled) so that the total fuel flow is as desired.

In one example, the manifold includes a primary portion and a secondary portion. At least one solenoid valve is associated with the primary portion. At least one solenoid valve is associated with the secondary portion. It is preferred to include more than one solenoid valve associated with the secondary portion. The controller preferably utilizes the solenoid valve associated with the primary portion to allow fuel flow through the primary portion during engine start up, for example. The controller controls operation of the solenoids associated with the secondary portion to provide fuel flow during normal engine operation.

In one example, each solenoid is associated with selected nozzles so that controlling the operation of each solenoid controls fuel flow through specific nozzles of the manifold assembly.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
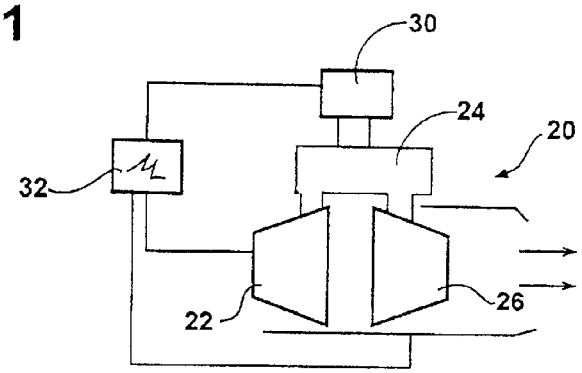
FIG. 1 schematically illustrates a gas turbine assembly including a fuel flow control system designed according to this invention.

FIG. 1 schematically illustrates a gas turbine assembly 20 including a compressor 22, a combustor 24 and a power turbine 26. The operation of such components is well known and the particular items used for each may be any of a variety of commercially available, suitable components.

A gas turbine assembly 20 includes a fuel supply device 30 that provides fuel to the combustor 24, which is mixed with compressed air from the compressor 22. The energy from burning the fuel and air in the combustor powers the turbine 26 in a conventional fashion. A controller 32 is programmed to control the operation of the compressor 22 and the fuel supply device 30 to achieve the desired turbine operation. In the illustrated example, the controller 32 receives information regarding the turbine operation to provide feedback for making further adjustments as may be necessary to the operation of the fuel supply device 30 so that the turbine operation is as desired.

Figure 2:
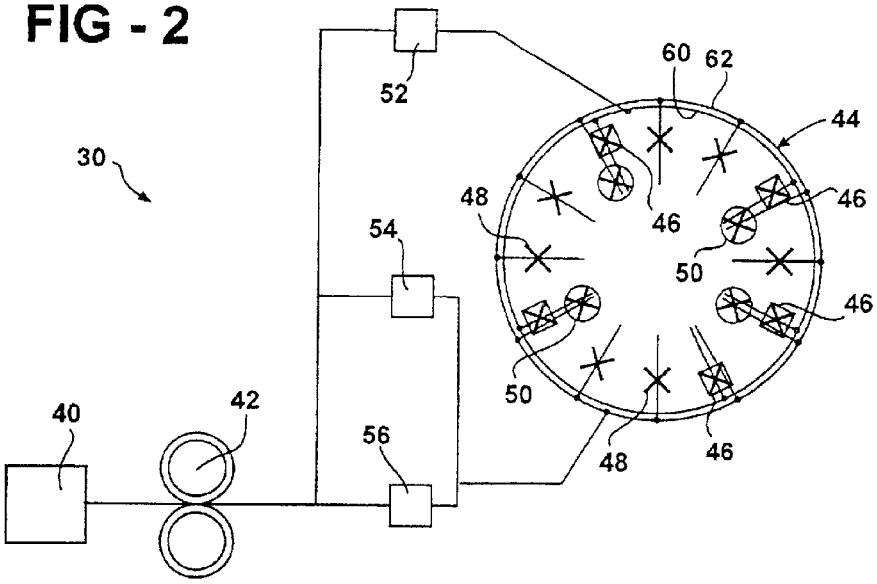
FIG. 2 schematically illustrates an example fuel flow control system designed according to this invention.

As schematically shown in FIG. 2, one example fuel supply device designed according to this invention includes a source of fuel 40 and a pump 42 that directs the fuel to a manifold assembly 44. A plurality of nozzles 46 are associated with the manifold assembly so that the fuel from the supply 40 passes through the nozzles and is supplied to the combustor 24 as needed. The illustrated example also includes nozzles 48 and 50 so that a variety of nozzle types provide the desired flow rate(s).

The fuel supply device 30 includes a plurality of solenoid valves 52, 54 and 56. These valves replace a conventional flow divider valve, which was commonly used to direct fuel flow between primary and secondary portions of a manifold similar to the assembly 44. Replacing a flow divider valve with the solenoid valves represents a significant advantage because the inventive arrangement is far more economical compared to the relatively costly flow divider valves. Additionally, the use of a plurality of solenoid valves according to this invention reduces the complexity of the system.

In the illustrated example of FIG. 2, the manifold 44 includes a first portion 60 and a second portion 62. The first portion 60 can be referred to as a primary portion of the manifold assembly. The solenoid 52 is opened or closed depending on the need for fuel to be supplied through the nozzles 46 associated with the first portion 60 of the manifold 44. An example use of the primary portion 60 of the manifold 44 is during engine start up. Under such conditions, the controller 32 preferably energizes or opens the solenoid valve 52 so that fuel from the source 40 is provided through the nozzles 46 to the combustor 24 as needed.

The solenoid valves 54 and 56 are both associated with the second portion 62 of the manifold 44. By selectively opening and closing the valves 54 and 56, a desired amount of fuel flow through the nozzles 48 and 50 is achieved.

Typical solenoid valves are not capable of operating at frequencies required to achieve desired turbine performance without introducing noise or vibration. This invention includes using multiple solenoids such as the solenoids 54 and 56 and controlling the timing and phase relationship of their operation so that the collective effect of the solenoids provides the desired fuel flow characteristic, even though an individual solenoid would not be capable of performing at the frequency levels required.

In one example, the valves 54 and 56 are each opened for a period of time that is less than the amount of time needed during an individual cycle of fuel supply. The open time for each solenoid valve may overlap the open time of another or they may be at discrete intervals within a given timing sequence. A further explanation of an example timing arrangement is provided below in conjunction with FIG. 5.

In the example of FIG. 2, one solenoid valve is associated with the primary portion 60 of the manifold 44 while multiple solenoid valves 54 and 56 are associated with the secondary portion 62. The manifold 44 of the example of FIG. 2 includes concentric rings that may be situated relative to the combustor 24 in a known fashion.

Figure 3:
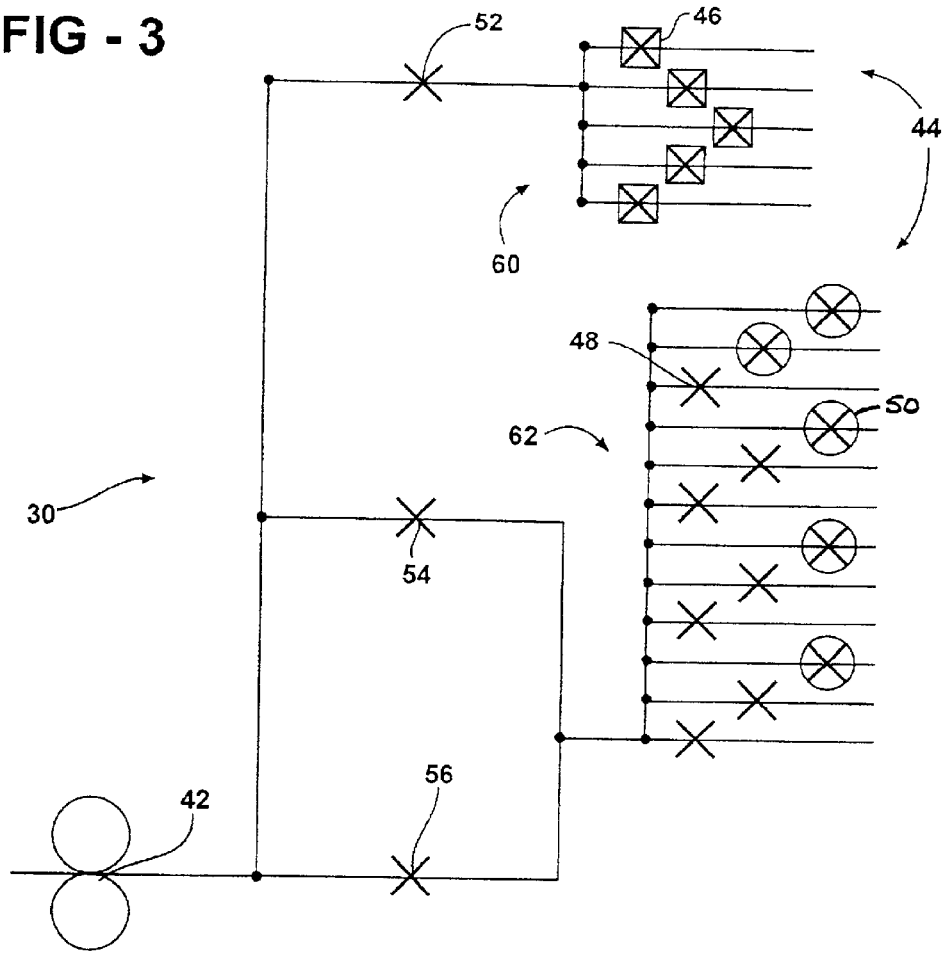
FIG. 3 illustrates another example fuel flow control arrangement.

The example of FIG. 3 is similar to that of FIG. 2 except that the style of the manifold assembly 44 is modified. In this example, the primary portion 60 and the secondary portion 62 are not concentric rings. Otherwise, the preferred operation of the example of FIG. 3 is the same as that of FIG. 2.

Figure 4:
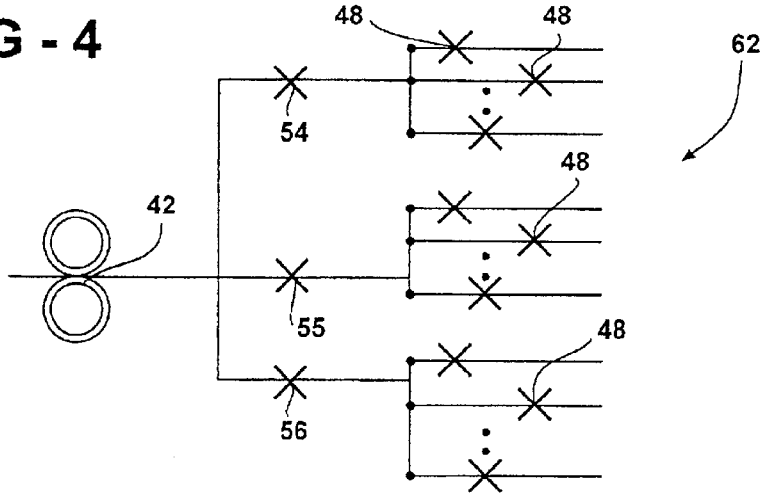
FIG. 4 illustrates still another example fuel flow control arrangement.

FIG. 4 illustrates still another example arrangement designed according to this invention. In this example, each solenoid valve is dedicated to a specific set of nozzles which are part of the manifold assembly 44. In the examples of FIGS. 2 and 3, a single solenoid valve 52 is associated with the primary portion 60 of the manifold and the associated nozzles 46 while the other solenoids control flow to all of the remaining nozzles. In the example of FIG. 4, a different solenoid valve is associated with specific ones of the nozzles. The solenoid 54 is associated with a first set of nozzles 48 while the solenoids 55 and 56, respectively, are associated with different sets of the nozzles 48. An arrangement as shown in FIG. 4 allows for particular nozzles to be utilized by controlling the open or close position of the associated solenoid. This is accomplished by suitably programming the controller 32.

The controller 32 can be realized using a commercially available microprocessor. The controller 32 may be a dedicated portion of a controller already associated with a turbine assembly or may be a dedicated microprocessor. Given this description, those skilled in the art will be able to select a suitable microprocessor and will be able to program it as needed to achieve the results provided by this invention.

Figure 5:
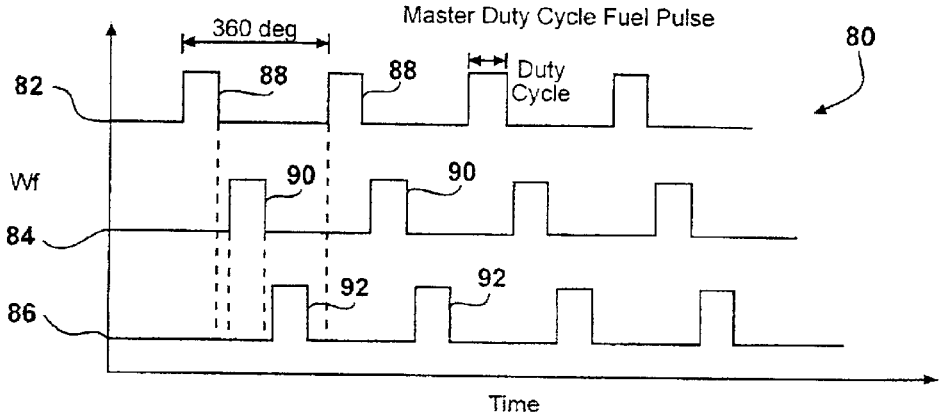
FIG. 5 is a timing diagram graphically illustrating a control strategy for controlling solenoids used to control fuel flow.

Referring to FIG. 5, a timing diagram for one example timing sequence for opening the solenoids 54, 55 and 56 of the example of FIG. 4 is shown. The plot 80 includes three energization timing lines 82, 84 and 86. Each of these lines represents the powering signals provided to the solenoids 54, 55 and 56, respectively, by the controller 32. The example illustration shows a timing sequence utilized when the fuel cycle is operating at 50 Hz. The total on time during which fuel is provided through the nozzles 48 within each sequence or cycle is approximately 75% of each cycle or 270° out of every 360°. An on time 88 for the solenoid 54 begins at the beginning of a cycle, for example. After the solenoid 54 is turned off, the solenoid 55 is turned on at 90. After the solenoid 55 is turned off, the solenoid 56 is turned on at 92. At the end of the first cycle, the solenoid 54 is then turned on again at 88 and the pattern is repeated as long as needed. The total on time for all of the solenoids provides the desired amount of fuel flow needed during each cycle.

The individual solenoids are not always capable of physically responding to control signals from the controller 32 to provide the desired timing operation of fuel flow. For example, any one of the solenoids would not turn off quickly enough if it were opened 75% of each cycle at 50 Hz. Without adequate close time, too much fuel per cycle would be delivered to the combustor. Turning each solenoid on about 25% of each cycle, however, permits each to close in enough time each cycle. The use of multiple solenoids provides the ability to achieve the desired fuel flow characteristic even with the physical performance limitations of currently available solenoid valves.

In the example of FIG. 5, the powering signals dictating the on times of each solenoid do not overlap. In another example (not specifically illustrated) the on time for each solenoid overlaps the on time of another so that the total on time for fuel flow is less than the sum total of all of the on times of each solenoid. Given this description and the characteristics of particular solenoid valves chosen, and the required fuel flow characteristics, those skilled in the art will be able to select an appropriate number of solenoids and to choose the necessary timing considerations to achieve a desired fuel flow characteristic.

As shown in FIG. 5, an example of this invention includes using pulse width modulation to power the solenoid valves to achieve the desired fuel flow. Combining the pulse width modulation technique with the timing considerations provides the overall fuel flow supply characteristic.

Depending on the operation frequency, the number of solenoid valves, the operating characteristic of the valves and the desired fuel flow, the phase relationship between the solenoids can be selected in a variety of manners to achieve the desired result.

Figure 6:
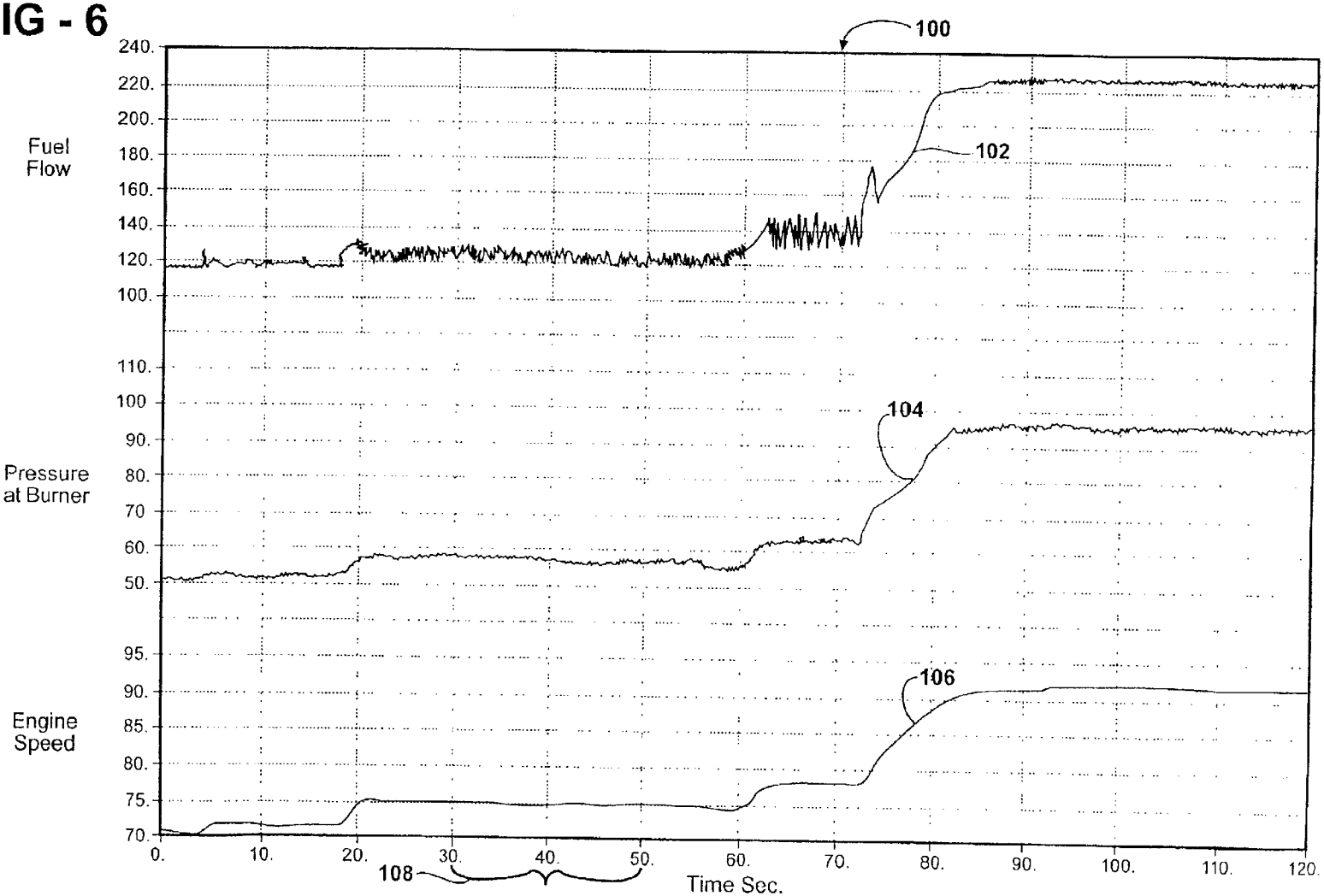
FIG. 6 graphically illustrates performance characteristics of an example turbine system incorporating a fuel flow control system designed according to this invention.

FIG. 6 graphically illustrates at 100 the performance of a turbine assembly 20 implementing a fuel supply device 30 designed according to this invention. The plot 102 shows the fuel flow provided by the manifold assembly 44 as a result of the controlled operation of the solenoid valves. The plot 104 shows the corresponding pressure at the burner of the turbine assembly. The plot 106 shows the engine speed, which is proportional to the output power of the turbine assembly. The illustrated example of FIG. 6 includes a closed loop control where the controller 32 obtains information regarding the engine speed 106. In such circumstances, the controller 32 preferably is programmed to utilize the current engine speed information and to compare that to a desired engine speed to fine tune or make adjustments to the current solenoid valve operation strategy to adjust the fuel flow so that the engine speed is brought into conformance with the desired speed.

Figure 7:
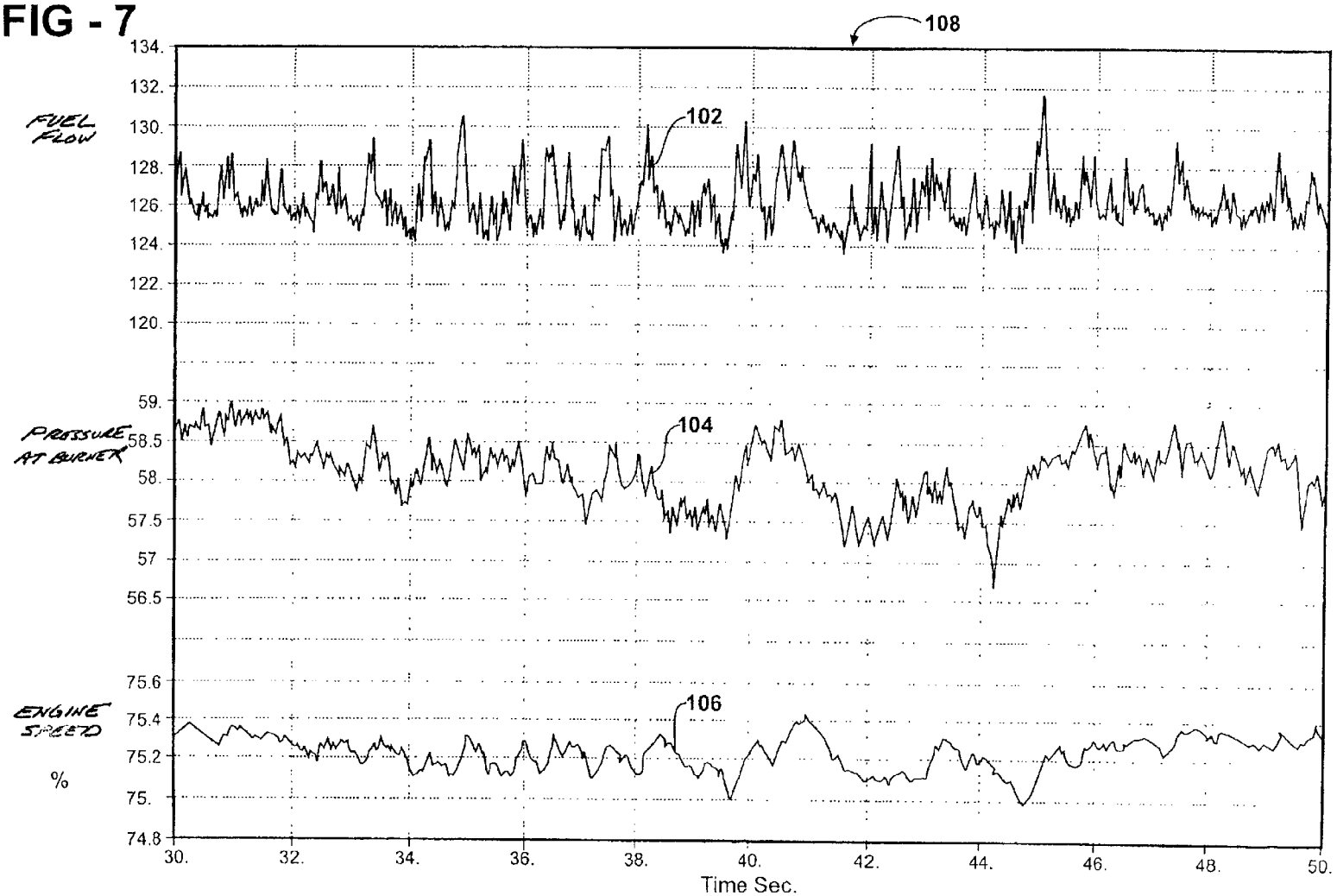
FIG. 7 is a more detailed illustration of selective portions of the illustration of FIG. 6.

The illustration of FIG. 7 shows the same plots 102, 104 and 106 in greater detail during the timing sequence 108 from FIG. 6. This illustration shows the accuracy of control obtainable using a multiple solenoid valve arrangement designed according to this invention.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A fuel flow control system for use in a gas turbine, comprising:

a fuel source;

at least one manifold coupled with the fuel source;

a plurality of nozzles near an end of the manifold that allow fuel to exit the manifold;

a plurality of solenoid valves associated with the manifold between the nozzles and the fuel source; and a controller that selectively opens and closes the solenoid valves, respectively, to provide a desired amount of fuel flow through the nozzles such that a sum total open time for all of the solenoid valves is greater than the time during which fuel flows through the nozzles.

2. The system of claim 1, wherein the controller uses pulse width modulation to control the solenoid valves and wherein a time during which fuel flows through the nozzles is greater than an open time for any one of the solenoid valves during a cycle.

3. The system of claim 1, wherein the manifold includes a first portion and a second portion and wherein at least one of the solenoid valves controls fuel flow through the first portion and at least one other of the solenoid valves controls fuel flow through the second portion.

4. The system of claim 3, wherein there are a plurality of the solenoid valves associated with the second portion.

5. The system of claim 3, wherein the manifold first portion comprises a ring and the second portion comprises a second ring.

6. The system of claim 1, wherein the controller determines a turbine speed and uses the speed information to control the solenoid valves to achieve a desired turbine performance.

7. A fuel flow control system for use in a gas turbine, comprising:

a fuel source;

at least one manifold coupled with the fuel source, the manifold including a first portion and a second portion;

a plurality of nozzles near an end of the manifold that allow fuel to exit the manifold;

a plurality of solenoid valves associated with the manifold between the nozzles and the fuel source, a plurality of the solenoid valves associated with the second portion, at least one of the solenoid valves controlling fuel flow through the first portion and at least one other of the solenoid valves controlling fuel flow through the second portion; and a controller that selectively opens and closes the solenoid valves, respectively, to provide a desired amount of fuel flow through the nozzles, the controller selectively opening the solenoid valve associated with the first portion during an engine start up procedure and closing the solenoid valve associated with the first portion during normal engine operation.

8. A fuel flow control system for use in a gas turbine, comprising:

a fuel source;

at least one manifold coupled with the fuel source;

a plurality of nozzles near an end of the manifold that allow fuel to exit the manifold;

a plurality of solenoid valves associated with the manifold between the nozzles and the fuel source; and a controller that selectively opens and closes each of the solenoid valves within a fuel supply cycle, to provide a desired amount of fuel flow through the nozzles, the controller modifying a phase relationship between the opening and closing different ones of the solenoids for a subsequent fuel supply cycle.

9. A fuel flow control system for use in a gas turbine, comprising:

a fuel source;

at least one manifold coupled with the fuel source, the manifold having a first portion and a second portion;

a plurality of nozzles near an end of the manifold that allow fuel to exit the manifold, at least one of the nozzles being associated with the first portion and at least one other of the nozzles being associated with the second portion;

a plurality of solenoid valves associated with the manifold between the nozzles and the fuel source, at least one of the solenoid valves being positioned to control flow between the fuel source and the first portion of the manifold; and a controller that selectively opens and closes the solenoid valves, respectively, to provide a desired amount of fuel flow through the nozzles such that a sum total open time for all of the solenoid valves is greater than the time during which fuel flows through the nozzles.

10. The system of claim 9, wherein the controller uses pulse width modulation to control the solenoid valves and wherein the a time during which fuel flows through the nozzles is greater than an open time for any one of the solenoid valves during a cycle.

11. The system of claim 9, wherein at least one other of the solenoid valves controls fuel flow through the second portion.

12. The system of claim 11, wherein there are a plurality of the solenoid valves associated with the second portion.

13. The system of claim 9, wherein the manifold first portion comprises a ring and the second portion comprises a second ring.

14. A fuel flow control system for use in a gas turbine, comprising:

a fuel source;

at least one manifold coupled with the fuel source, the manifold having a first portion and a second portion;

a plurality of nozzles near an end of the manifold that allow fuel to exit the manifold, at least one of the nozzles being associated with the first portion and at least one other of the nozzles being associated with the second portion;

a plurality of solenoid valves associated with the manifold between the nozzles and the fuel source, at least one of the solenoid valves being positioned to control flow between the fuel source and the first portion of the manifold; and a controller that selectively opens and closes the solenoid valves, respectively, to provide a desired amount of fuel flow through the nozzles, the controller selectively opening the solenoid valve associated with the first portion during an engine start up procedure and closing the solenoid valve associated with the first portion during normal engine operation.

15. A method of controlling fuel flow in a turbine assembly, comprising the steps of:

providing a plurality of solenoid valves between a fuel source and a plurality of nozzles associated with a manifold; and controlling an open time for each solenoid and a phase relationship between the open times during a cycle such that a sum total of all of the open times is greater than a time during which fuel is flowing through the nozzles and an amount of fuel flow through each solenoid is less than that required during the cycle to achieve a total fuel flow through the solenoids that provides a desired turbine performance.

16. The method of claim 15, including providing at least one solenoid in association with a first portion of a fuel manifold and controlling the at least one solenoid to allow fuel flow only during a turbine start up procedure.

17. The method of claim 15, including overlapping the open times of at least two of the solenoids.

18. The method of claim 15, including determining a current turbine speed and adjusting at least one of the phase relationship or the open times responsive to the determined speed relative to a desired speed.

19. A fuel flow control system for use in a gas turbine, comprising:

a fuel source;

at least one manifold coupled with the fuel source;

a plurality of nozzles near an end of the manifold opposite from the fuel source that allow fuel to exit the manifold;

a plurality of solenoid valves between the manifold and the fuel source; and a controller that selectively opens and closes the solenoid valves, respectively, such that each solenoid valve opens and closes within a fuel supply cycle and the open time of each solenoid during the fuel supply cycle is less than the time of the fuel supply cycle.

* * * * *